US005454017A

United States Patent [19]

Price et al.

[11] Patent Number: 5,454,017

[45] Date of Patent: Sep. 26, 1995

[54] METHOD AND APPARATUS FOR IMPROVED SHEET PROCESSING

[75] Inventors: John G. Price, Bishops Waltham; Ernest A. Munn, Havant; Graham R. Morgans, Portsmouth, all of United Kingdom

[73] Assignee: De La Rue Systems Limited, United Kingdom

[21] Appl. No.: 198,154

[22] Filed: Feb. 17, 1994

[30] Foreign Application Priority Data

Feb. 18, 1993 [GB] United Kingdom ..... 9303222

[51] Int. Cl.[6] ..... G06M 7/00

[52] U.S. Cl. ..... 377/8

[58] Field of Search ..... 377/8

[56] References Cited

U.S. PATENT DOCUMENTS

| | | | |
|---|---|---|---|
| 4,064,391 | 12/1977 | Kokubo et al. | 377/8 |
| 4,385,229 | 5/1983 | Middleditch | 377/8 |
| 4,569,066 | 2/1986 | Hibari | 377/8 |
| 4,974,237 | 11/1990 | Grabowski | 377/8 |

FOREIGN PATENT DOCUMENTS

| | | |
|---|---|---|
| 2041888 | 9/1980 | United Kingdom . |
| 2137000 | 9/1984 | United Kingdom . |
| 2205641 | 12/1988 | United Kingdom . |
| 2238895 | 6/1991 | United Kingdom . |

*Primary Examiner*—Margaret Rose Wambach
*Attorney, Agent, or Firm*—Ostrolenk, Faber, Gerb & Soffen

[57] ABSTRACT

A sheet counting apparatus includes a set of rotatably mounted suction spindles mounted for movement past a stack of sheets to be counted. A pump is connected to the spindles whereby a suction spindle passes the stack, a vacuum is supplied to the spindle so that the topmost sheet is deflected from its initial position. A monitoring system monitors the number of deflected sheets by monitoring the degree of vacuum within the suction spindle passing the stack. The monitoring system increments a count on each occasion when the monitored vacuum exceeds a predetermined threshold. The monitoring system terminates the count process when a predetermined period is exceeded without the vacuum exceeding the predetermined threshold, the predetermined period corresponding to the passage of at least two spindles past the stack of sheets, without the spindles deflecting a sheet.

21 Claims, 5 Drawing Sheets

METHOD AND APPARATUS FOR IMPROVED SHEET PROCESSING

FIELD OF THE INVENTION AND DESCRIPTION OF THE PRIOR ART

It is already known to provide an apparatus for counting sheets held in a stack, the apparatus comprising a set of rotatably mounted suction spindles mounted for movement past a stack of sheets to be counted, vacuum supply means connected to the spindles, whereby as a suction spindle passes the stack, a vacuum is supplied to the spindle so that the topmost sheet is deflected from its initial position; and monitoring means for monitoring the number of deflected sheets. Such an apparatus is hereinafter referred to as of the kind described and is commonly referred to as a "spindle counter".

Most spindle counters require a minimum pressure (vacuum) to be maintained within the system with the counting of the sheets being performed by means of external electromagnetic/photoelectric sensors which operate independently of the vacuum system provided the minimum pressure is maintained. An example is described in GB-A-2041888.

Another approach is to detect changes in the pressure or vacuum supplied to the spindles. An increase in vacuum (decrease in pressure) corresponds to a sheet being deflected and this change can be used to count the number of deflected sheets. Examples of such spindle counters are described in GB-A- 2238411, GB-A-2238895, and GB-A-1530652.

In some of these known spindle counters, for example those described in GB-A-2238411 and GB-A-2238895, it is necessary to index the spindles to a known position prior to the start of the count process. This is undesirable.

A further problem with systems such as that described in GB-A-2238895 is that if a spindle fails to deflect a note during a count process, the system will stop. This leads to problems in that the whole process has to be restarted.

SUMMARY OF THE INVENTION

In accordance with one aspect of the present invention, we provide an apparatus of the kind described wherein the monitoring means monitors the degree of vacuum within the suction spindle passing the stack whereby the monitoring means increments a count on each occasion when the monitored vacuum exceeds a predetermined threshold, the monitoring means terminating the count process when a predetermined period is exceeded without the vacuum exceeding the predetermined threshold, the predetermined period corresponding to the passage of at least two spindles past the stack without deflecting a sheet.

In accordance with a second aspect of the present invention, a method of counting sheets an apparatus comprising a set of rotatably mounted suction spindles mounted for movement past a stack of sheets to be counted, whereby as a suction spindle passes the stack, a vacuum is supplied to the spindle so that the topmost sheet is deflected from its initial position, comprises the steps of monitoring the degree of vacuum within the suction spindle passing the stack and incrementing a count on each occasion when the vacuum exceeds a predetermined threshold; and terminating the count process when a predetermined period is exceeded without the vacuum exceeding the predetermined threshold, the predetermined period corresponding to the passage of at least two spindles past the stack of sheets without deflecting a sheet.

The invention overcomes the problems mentioned above by permitting at least one spindle to pass the stack without deflecting a sheet and continuing the count process. In particular, the count process will only be terminated if at least two spindles have passed the stack of sheets without deflecting a sheet. The invention also has an advantage at start-up in that it can permit a predetermined number (for example 5) of spindles to pass the stack without deflecting a sheet. If sheets start to be deflected during this period then these will be counted due to the drop in pressure but if all the predetermined number of spindles pass the stack without deflecting a sheet then the monitoring means will indicate this as being the end of a count process.

The predetermined period may be the same throughout a count process or the period may be different at the start of a count process than during the remainder of the process.

A further advantage of this aspect of the invention is that it provides significant improvements in the ability to count stiff or otherwise difficult to pick sheets.

Preferably, the apparatus further comprises a central porting member about which the spindles rotate, the central porting member having a vacuum supply port connected to the vacuum supply means, and a vacuum sensing port connected to the monitoring means, the vacuum supply and sensing ports being positioned such that during rotation of a spindle past the sheet stack, a spindle vacuum port will initially communicate only with the vacuum supply port, then with both the vacuum supply and sensing ports, and finally with only the vacuum sensing port.

The monitoring means can also be used for diagnostic purposes. Thus, when the spindles are stationary and the vacuum port of the spindle is covered, the application of a vacuum can be sensed by the monitoring means to provide an absolute indication of the vacuum level. This can then be used to adjust the vacuum level to a desired strength.

Alternatively and in a particularly preferred arrangement, the pressure can be sensed under dynamic conditions when the apparatus is operating and deflecting sheets. When a sheet is in the process of being deflected, vacuum and pressure signals for that sheet can be sensed and stored in a data store such as a RAM device and retrieved at a later stage to indicate how the apparatus performed. Numerical calculations may also be performed using the data recorded to provide derivative information such as the number of sheets which the spindles failed to pick the first time or to provide a warning that cleaning is required as indicated by a rise in vacuum level when no sheets are deflected.

A known apparatus of the kind described, where the pressure or vacuum within the suction spindle passing the stack is monitored to determine the number of deflected sheets, relies on providing a threshold level against which the monitored pressure or vacuum is compared.

We have found that during a count, the peak vacuum level can decrease for various reasons such as porosity of the notes, and the reduction in force with which the stack of sheets is fed towards the suction spindles since this is normally under the control of an uncoiling spring or tension spring. In extreme cases this peak vacuum level could drop below the initially preset threshold causing a count to be aborted.

In accordance with a third aspect of the present invention, we provide an apparatus of the kind described in which the monitoring means monitors the degree of vacuum within the suction spindle passing the stack, whereby the presence of a vacuum exceeding a predetermined threshold indicates that a sheet is being deflected, the monitoring means thereupon incrementing a count, and wherein the monitoring means adapts the threshold during a count process by regularly resetting the threshold at a preset proportion of a rolling average of a predetermined number of previous vacuum levels detected as indicating the deflection of a sheet.

In accordance with a fourth aspect of the present invention, we provide a method of counting sheets using apparatus comprising a set of rotatably mounted suction spindles mounted for movement past a stack of sheets to be counted, whereby as a suction spindle passes the stack, vacuum is supplied to the spindle so that the topmost sheet is deflected from its initial position, the method comprising the steps of monitoring the degree of vacuum within the suction spindle passing the stack, whereby the presence of a vacuum exceeding a predetermined threshold indicates that a sheet has been deflected, incrementing a count when a vacuum exceeding the predetermined threshold is monitored, and adapting the threshold during the count process by regularly resetting the threshold at a proportion of a rolling average of a predetermined number of previous vacuum levels detected as indicating the deflection of a sheet.

This aspect of the invention overcomes the problems outlined above by adapting the threshold during the count process. Typically, the most recent eight pressure levels are averaged and a proportion such as 25–50% of this average used to constitute the threshold with which the next pressure level is compared. It should be noted, of course, that it is only the preceding pressure levels which exceed thresholds which are used in computing the rolling average. If, for example, a suction spindle does not deflect a sheet for any reason, the detected (high) pressure level is not used to compute the rolling average.

A problem which is encountered in various sheet feeding systems in which sheets are taken from a stack, but which is particularly significant in the case of the apparatus of the kind described, is in controlling the force by which the stack of sheets is urged towards the sheet processing position. Conventionally, this has done under the control of a tension spring as described, for example, in GB-A-2028282 or a bellows as described in GB-A-2039112. However, in neither case does the force remain constant throughout the feed operation which is undesirable example for the reasons described above in connection with monitoring pressure levels.

In accordance with a fifth aspect of the present invention, a method of feeding a stack of sheets to a sheet processing position comprises the steps of mounting the stack against a pivoted support plate; and causing a drive motor to pivot the support plate towards the sheet processing position while sheets from the stack are being processed.

In accordance with a sixth aspect of the present invention, an apparatus for feeding a stack of sheets to a sheet processing position comprises a pivoted sheet stack support plate against which a stack of sheets is provided in use; and a motor coupled to the support plate to move the support plate towards the sheet processing position while sheets from the stack are being processed.

In the past, a motor has been used to move the support plate from a retracted position in which a stack of sheets can be loaded onto the plate and the processing position where the stack of sheets is ready to be processed. Thereafter, the support plate has been urged towards the sheet processing position during processing under the control of a spring or bellows. We provide instead a controlled movement of the support plate towards the sheet processing position under the influence of the motor which enables the force with which the stack is urged towards the sheet processing position to be closely controlled and preferably kept substantially constant. By using the same motor which is used conventionally to move the plate between the retracted and processing positions, no additional drive means is required.

Typically, the drive motor is coupled to the support plate via a spring, such as a tension spring. In this case, the end of the tension spring coupled to the drive motor is moved against its tensioning direction to cause the plate to pivot towards the sheet processing position, the spring accommodating small vibrations of the plate.

Preferably, the drive motor is coupled to a rack to which one end of the spring is connected, the other end of the spring being attached to an arm connected to the support plate and pivoted about the same axis as the support plate whereby rotation of the arm causes rotation of the plate. In this case, the arm and plate are conveniently mounted on the same shaft.

The rack may also be rotatably mounted about the same pivot axis as the arm and the plate.

Preferably, the rack includes a laterally extending pin which is received in a slot in the arm whereby the plate is moved to its retracted position by moving the rack so that the pin contacts an end of the slot and thereafter pivots the arm.

Typically, the apparatus further includes a clamp arm which is urged into contact with the stack of sheets on the plate. This is particularly useful where the apparatus is used in connection with a spindle counter of conventional form or in accordance with any of the preceding aspects of the invention.

The method and apparatus according to the fifth and sixth aspects of the invention are applicable both to conventional spindle counters and also methods and apparatus according to the first to the fourth aspects of the invention.

It will be understood that all aspects of the invention are suitable for handling and counting sheets of various types but they are particularly suitable for use with banknotes.

BRIEF DESCRIPTION OF THE DRAWINGS

An example of a spindle counter according to the invention will now be described with reference to a preferred embodiment of the accompanying drawings, in which.

DETAILED DESCRIPTION OF THE EMBODIMENT

Figure 1:
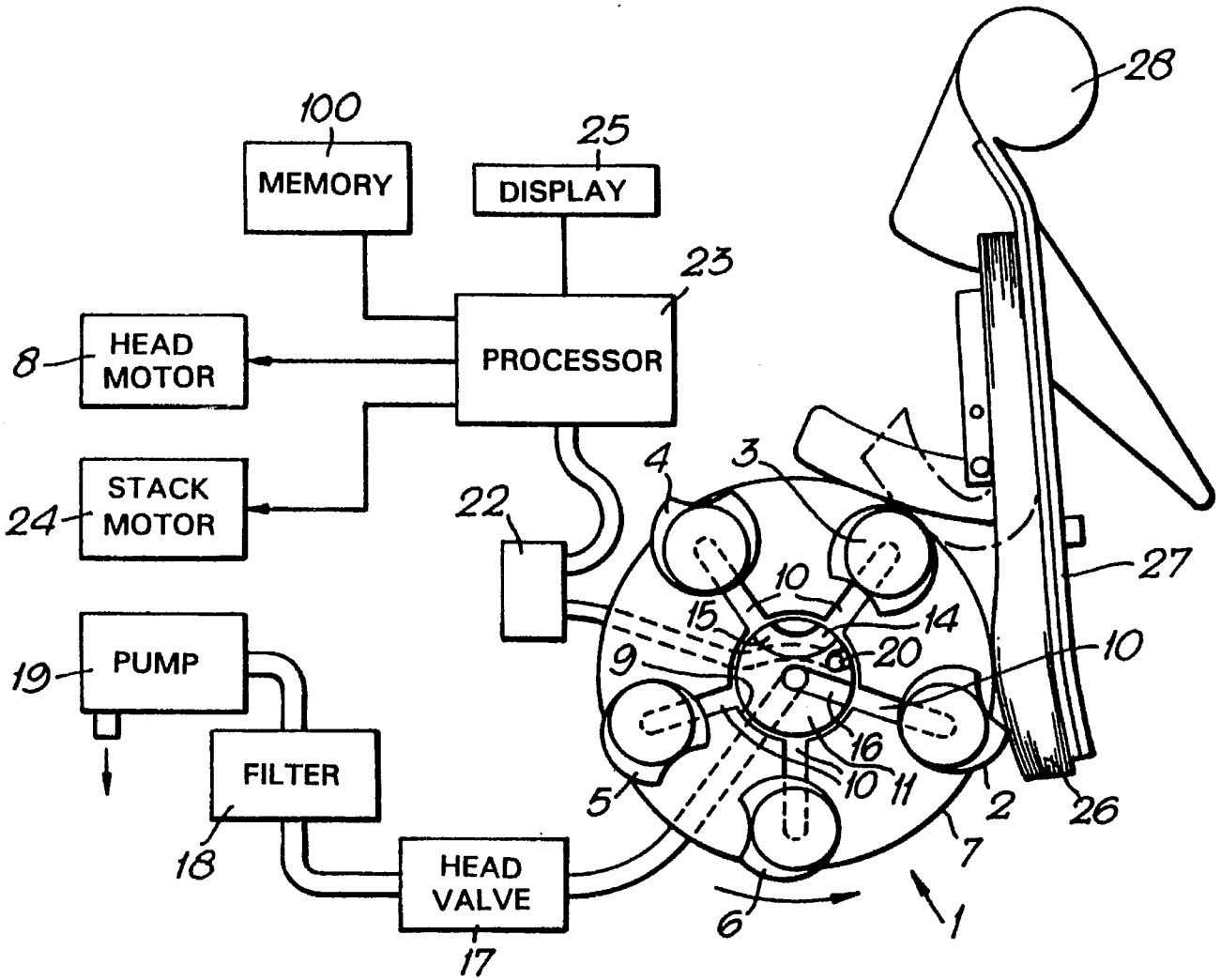
FIG. 1 is a schematic diagram of the apparatus with the head in a first position.
Figure 2:
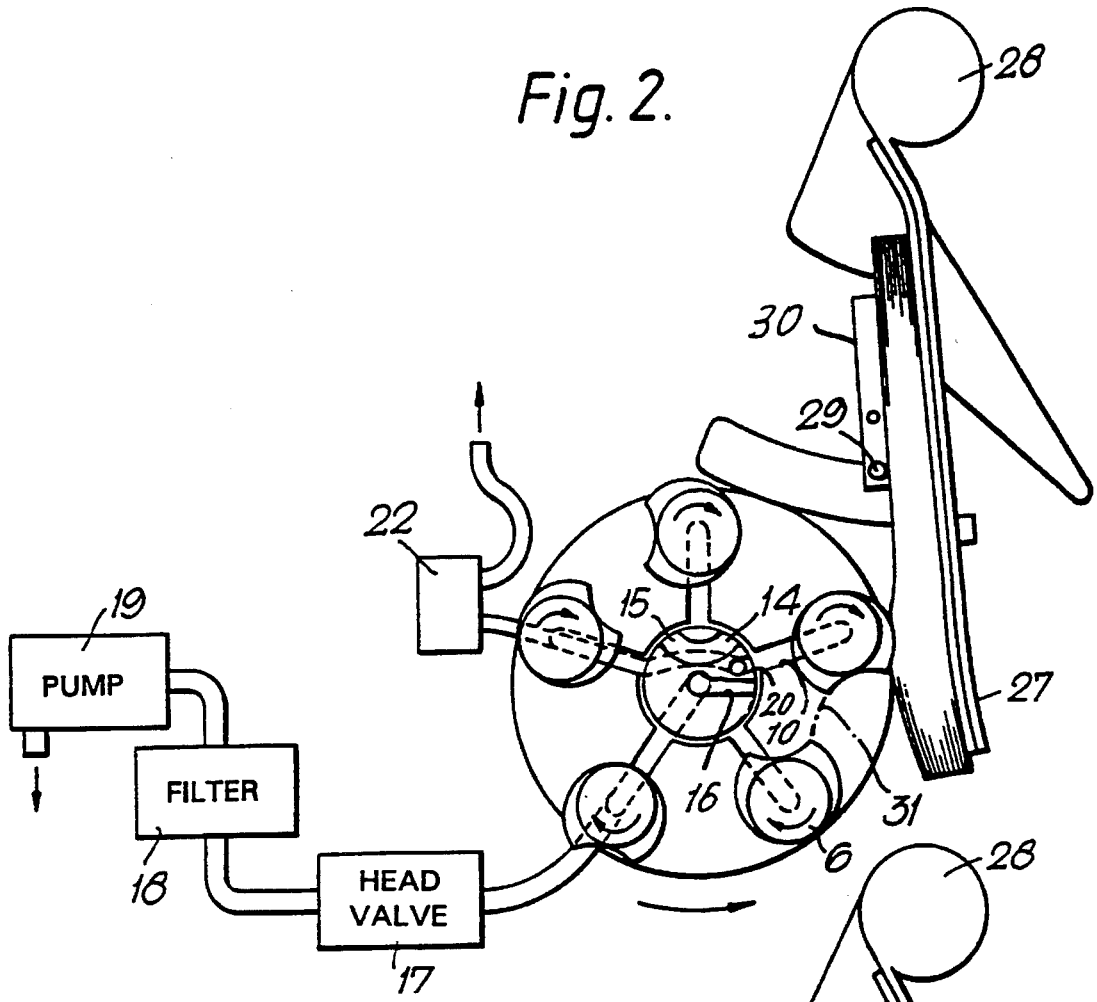
FIG. 2 is a view similar to FIG. 1 (with parts omitted) with the head in a second position.
Figure 3:
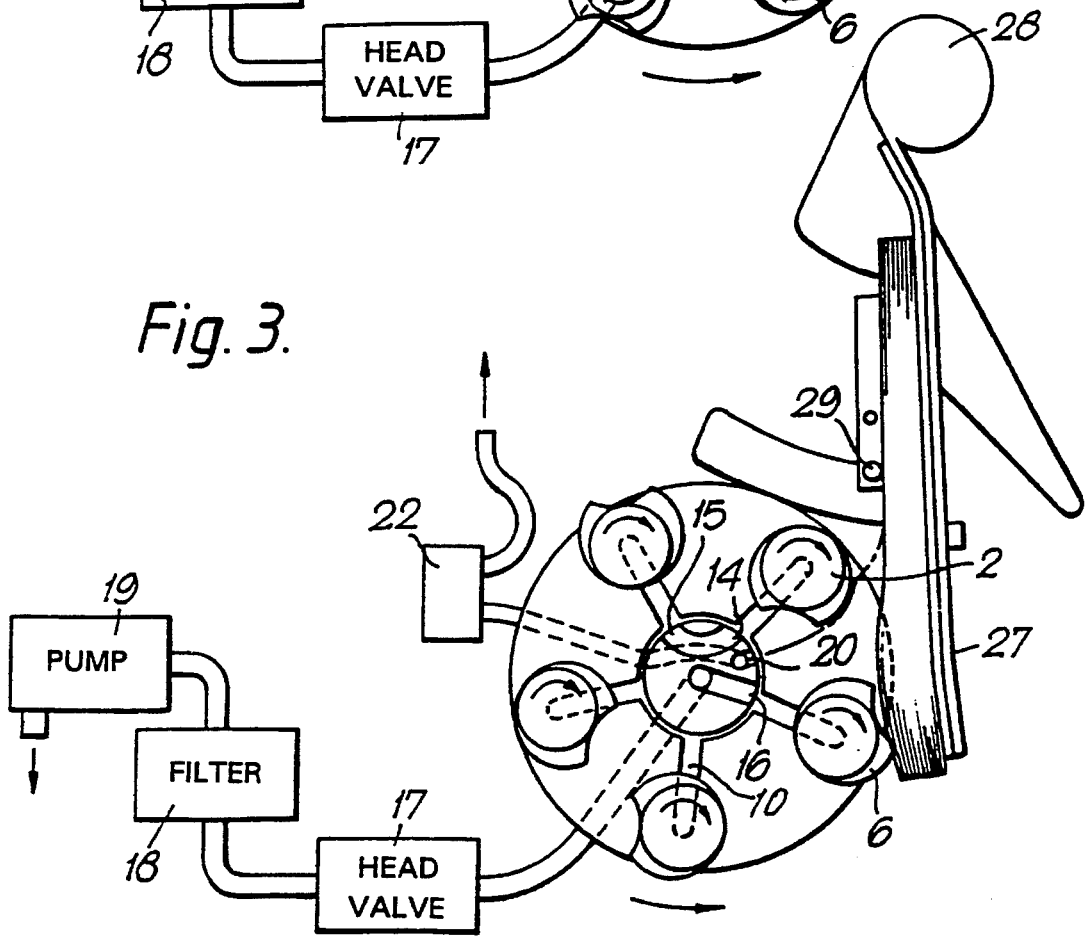
FIG. 3 is a view similar to FIG. 2 with the head in a third position.

The apparatus shown in FIGS. 1 to 3 is of substantially conventional form, particularly the construction of the head 1. The head 1 comprises five substantially equally angularly spaced suction spindles 2–6 rotatably mounted on a main support 7 which itself is rotatable under the control of a head motor 8. The support 7 is rotated in use in a counter-clockwise direction (as seen in FIG. 1) while the suction spindles 2–6 are rotated in a clockwise direction. The gear assemblies for achieving these rotations are well known and will not be described further.

Figure 4:
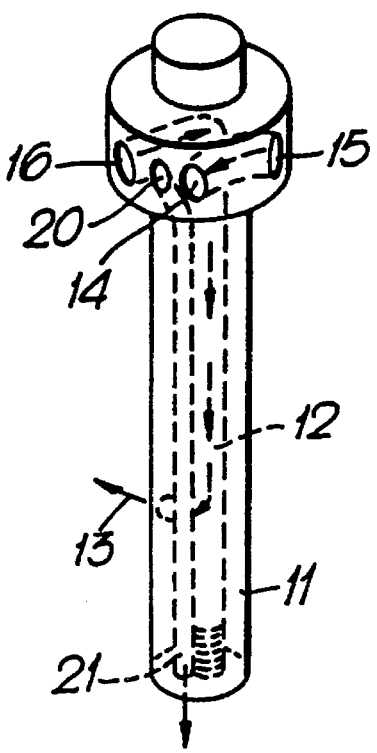
FIG. 4 illustrates the centre spindle in more detail.

The support 7 has a central bore 9 extending along its axis and communicating with a set of five ports 10 which communicate with respective suction spindles 2–6. The support 7 rotates about a central spindle 11 mounted within the bore 9 and shown in more detail in FIG. 4. The central spindle 11 has a central bore 12 which is connected to an exhaust port 13 at one end which in turn is connected to a head valve 17, filter 18 and a vacuum pump 19. At its end level with the ports 10, the bore 12 terminates in port 16. Circumferentially spaced exhaust ports 14,15 are provided for communication with the ports 10. Between the ports 14,16 is a counting port 20 which communicates through a bore 21 in the central spindle 11 with a pressure transducer 22.

The pressure transducer 22 is of conventional form and generates an electronic signal related to the sensed pressure. This signal is fed to a microprocessor 23 connected to control the head motor 8, a stack motor 24, and a display 25. The operation of the processor 23 will be described in more detail below.

A stack of sheets 26 to be counted are loaded onto a support plate 27 pivoted about a shaft 28. As seen in FIG. 2, the end of the stack nearest the shaft 28 is clamped in position by a clamp pin 29 mounted on an arm 30.

In operation, the support plate 27 carrying a stack of sheets such as banknotes is brought to the position shown in FIGS. 1–3 and the processor 23 is then instructed to control the head motor 8 to start operation. The head motor 8 rotates the support 7 in a counter-clockwise direction thereby causing the spindles 2–6 to rotate in a clockwise direction and the first spindle 2 will arrive at the stack 26 (FIG. 1). A vacuum is supplied from the vacuum pump 19 to the port 16 so that as the port 10 associated with the spindle 2 approaches the position shown in FIG. 1, the vacuum will be communicated through the port 16 and port 10 to the suction spindle 2. The suction spindle 2 will thus suck the topmost banknote against its outer periphery. Further rotation of the support 7 and spindle 2 draws the topmost banknote (shown at 31 in FIG. 2) away from the stack. As the spindle 2 continues to rotate, the port 10 associated with the spindle 2 will move round to overlap the vacuum and counting ports 16,20. This has the effect of connecting the vacuum to the transducer 22 via the bore 21 so that the transducer detects the high level of vacuum. As the head 1 continues to rotate, the port 10 becomes disconnected from the vacuum port 16 remaining connected only to the counting port 20 (FIG. 2). Shortly after this, as the head continues to rotate, the port 10 associated with the spindle 2 will overlap both the counting port 20 and exhaust port 14. This allows the vacuum present in the sealed spindle to be opened to the atmosphere via ports 14 and 15, cancelling the stored vacuum. This also opens the counting port 20 to the atmosphere. At this time the sheet held by the spindle 2 is released due to the loss of vacuum and further rotation brings the port 10 solely into line with port 14 (FIG. 3). As the head 1 rotates further, the sequence repeats for the next spindle 6 and so on.

Due to the overlapping action of the counting port 20 with the vacuum and exhaust ports 16,14, the transducer 22 will detect first a rise in vacuum, followed by a drop as the port 20 is connected to the exhaust port 14. This means that for each sheet, the transducer will generate a pulse, allowing the processor 23 to count these pulses and thereby count the number of sheets in the stack. This number is then displayed on the display 25 which is in the form of a LCD or the like.

Figure 5:
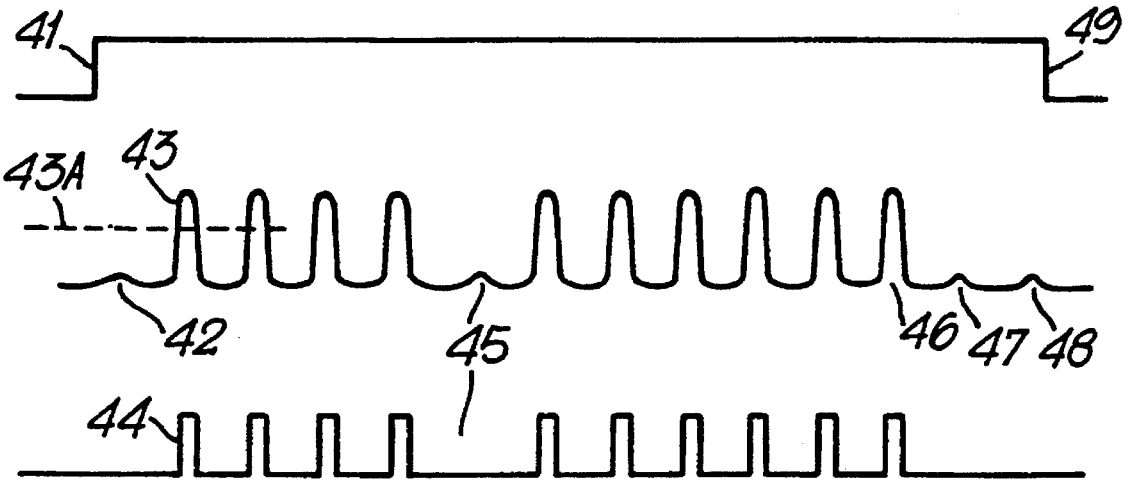
FIG. 5 illustrates a typical count sequence.

FIG. 5 illustrates a typical count sequence. Initially, the processor 23 activates the head motor 8 (step 41). The head 1 then begins to rotate and in this case, the first head 2 fails to pick the topmost sheet from the stack. Consequently, as shown in 42, only a small rise in vacuum level is measured. This rise does not exceed a predetermined threshold 43A and consequently no count pulse is generated within the processor 23. The next spindle successfully picks the topmost sheet thus causing a significant vacuum to be communicated into the counting port 20 so that the transducer 22 senses a drop in pressure which exceeds the predetermined threshold 43A. This is indicated at 43 in FIG. 5. As soon as the sensed vacuum exceeds the threshold, the processor 23 will generate a count pulse 44 which increments an internal count while the count to date is displayed on the display 25.

This process continues as shown in FIG. 5 but where a spindle fails to pick a sheet, as at 45, no count pulse is generated. After the failure 45, the next spindle successfully picks the note so that counting continues until the last sheet is picked as shown at 46. After this, two further spindles will attempt to pick sheets from the stack but since no sheets will be picked, only small changes in vacuum level will be sensed as shown at 47 and 48.

The processor 23 is programmed to expect a count pulse within a certain time period and consequently, if the time period passes without a count pulse being generated, then the processor decides that the counting process should terminate and switches off the head motor at step 49. The time period will usually be long enough to permit two or three spindles to attempt to pick a note.

It will be seen from this description that there is no need to position the head 1 at a particular index position prior to commencing the count process. Counting is automatically carried out and although it is likely that for an initial period no sheets will be picked as the sheets are being fed towards the spindles on the support plate 27, the processor 22 can accommodate this by not incrementing the count. Providing a note is counted before an initial, predetermined period expires then the process will continue. If for some reason no sheet is detected within that predetermined period then the head motor 8 will be stopped.

The system determines that the end of a count cycle has taken place in a similar way although the predetermined period could be different, usually shorter, than the predetermined period at start-up. For example, the predetermined period at start-up could correspond to the passage of three or four spindles past the stack while the predetermined period at the end of a count cycle could correspond to the passage of two or three spindles.

Figure 6:
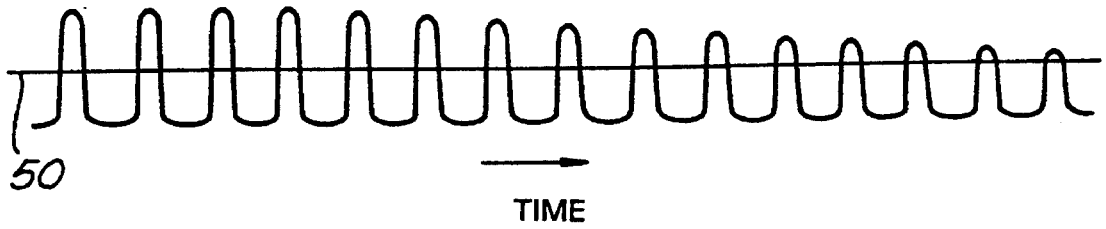
FIG. 6 illustrates the variation of sensed pressure against a constant threshold.

In the example just described it has been assumed that the vacuum level threshold is constant throughout the counting process. FIG. 6 illustrates such an example in which the threshold level is indicated at 50. As can be seen, the vacuum signal drops with time due to the decrease in the pressure with which the stack is urged towards the spindles. This could result in a vacuum level, due to a sheet being picked, not exceeding the threshold with the result that the sheet is not counted.

Figure 7:
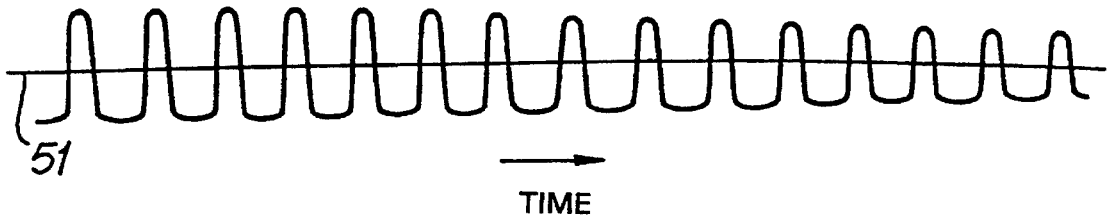
FIG. 7 illustrates the variation of sensed pressure against an adaptive threshold; and, FIG. 8 is a schematic, perspective view of part of the sheet stack control system.

To overcome this problem, the processor 23 can monitor and store in a store or memory 100 the last N vacuum threshold levels which exceeded a threshold (N is typically eight) and were used to increment the count and can compute an average of those N levels from which a new threshold is calculated. For example, the processor could compute the average of the last three vacuum levels which exceeded a threshold and define the new threshold as being a proportion, for example 25–50%, of the new average. FIG. 7 illustrates a threshold level 51 which is varied using this technique and it can be seen that later pulses, although having a smaller absolute vacuum level magnitude, exceed the current threshold by similar proportions to the initial levels.

The sheet stack is, as previously described, mounted on a support plate 27 which in turn is mounted on a feed shaft 28 for rotation therewith. The system for controlling the orientation of the shaft 28 is shown in more detail in FIG. 8. The shaft 28 is rotatably mounted in bearings supported in housings 55 which are in turn mounted on a bracket 56. A shaft drive arm 57 which is non-rotatably mounted on the shaft 28 extends laterally away from the shaft 28 and is positioned adjacent a rack 58 which is rotatably mounted about the shaft 28. The teeth 59 of the rack 58 engage a drive pinion 60 which is connected to the stack motor 24 (not shown in FIG. 8). The arm 57 is connected to the rack 58 via a tension spring 61.

A stop pin 62 extends laterally from the rack 58 into an aperture 63 in the arm 57. The arm 57 also carries an adjustable screw 64.

The shaft 28 also rotatably carries the clamp arm 30 which is connected in use to a torsion spring 65 to urge the clamp pin 29 against a stack held on the support plate.

Figure 8:
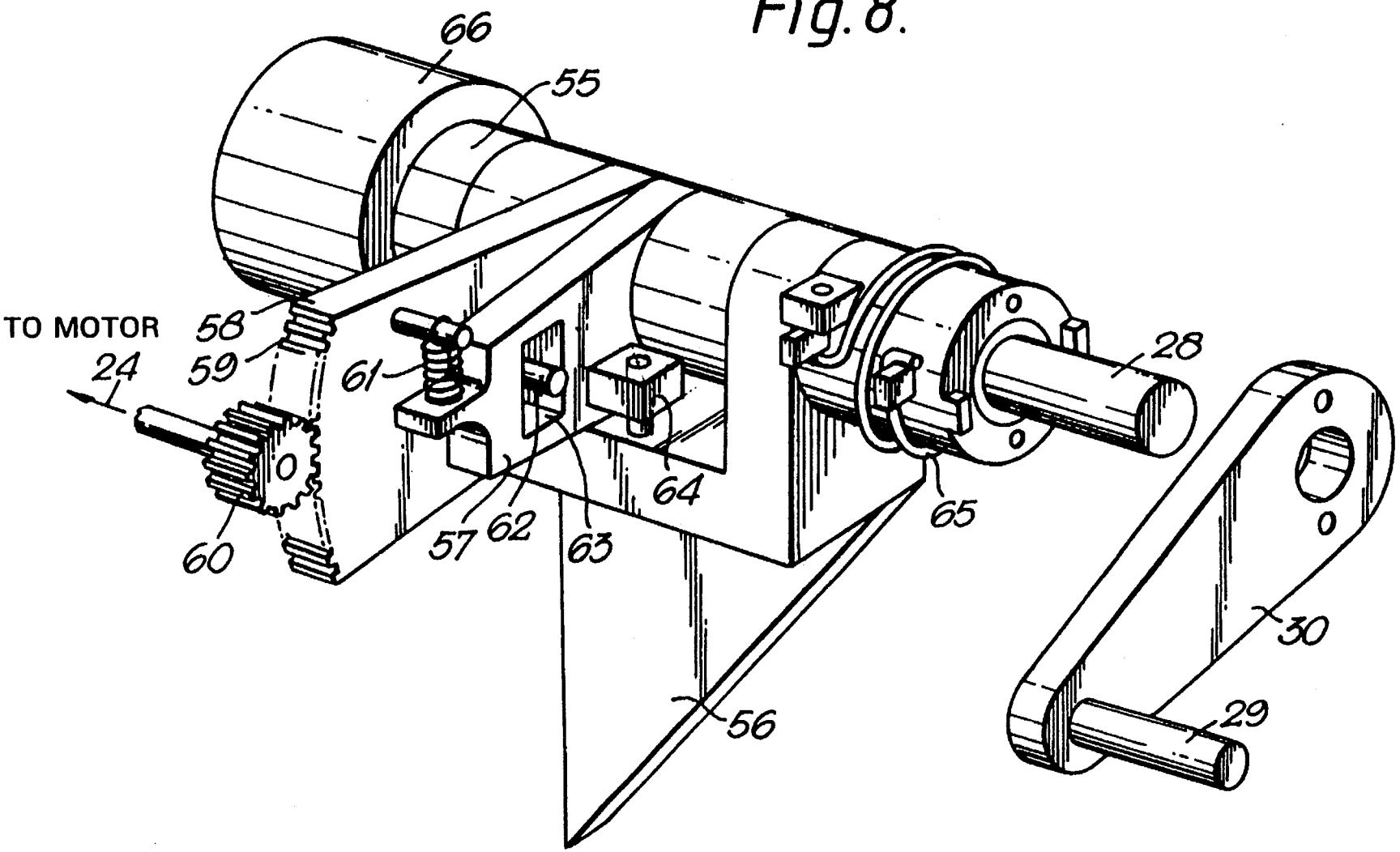

The operation of the system shown in FIG. 8 will now be described. Consider the position in which the plate 27 is in its forward position as shown generally in FIGS. 1 to 3. Following the counting of a batch of sheets, the motor 24 is activated to rotate the rack 58 in a counter-clockwise direction (as seen in FIG. 8) which causes the stop pin 62 to move relative to the aperture 63 in the arm 57 and until the pin engages the lower side of the aperture whereupon the arm 57 is also rotated counter-clockwise until the adjustor screw 64 is positioned on the brackets 56. When this occurs, a current over limit device (not shown) stops the motor.

The stack of sheets to be counted is then loaded onto the plate 27 on which it is held by the clamp pin 29. The motor 24 is then activated to rotate the rack 58 in a clockwise direction moving the stop pin 62 away from the lower side of the aperture 63. Once the pin 63 reaches substantially the position shown in FIG. 8, the tension spring 61 will start to draw the arm 57 in a clockwise direction. This movement continues not only (at a relatively fast rate) to bring the stack of sheets initially into position but also (at a relatively slow rate) during the counting operation with the tension spring exerting a reasonably uniform feed load on the sheets. The speed of the motor 24 is controlled by an over current limiter. Thus, if the note feed is too fast, then pin 62 drives up against the shaft drive arm thereby increasing the load on the drive motor. This increase in load is measured by a current limiting device which slows down the drive motor. In this way, a substantially constant load is imparted on the stack of sheets throughout the counting operation. The operation of this mechanism to count sheets may be improved with the addition of a damper (66) acting on the feedshaft (28).

We claim:

1. Sheet counting apparatus comprising;

a plurality of rotatably mounted suction spindles mounted for movement past a stack of sheets to be counted;

vacuum supply means connected to said spindles for supplying a vacuum to one of said spindles as said one of said suction spindles passes said stack so that a topmost sheet of said stack is deflected by said one of said spindles from an initial position of the topmost sheet; and monitoring means for monitoring a number of deflected sheets and for monitoring an amount of vacuum within said suction spindle passing said stack, said monitoring means performing a count process by incrementing a count on each occasion when a monitored amount of vacuum exceeds a predetermined threshold, said monitoring means terminating the count process when a predetermined period is exceeded without the amount of vacuum exceeding the predetermined threshold, the predetermined period comprising a time period required for passage of at least two said spindles past said stack of sheets without said spindles deflecting a sheet.

2. Apparatus according to claim 1, wherein said predetermined period is the same throughout the count process.

3. Apparatus according to claim 1, wherein each of said spindles includes a spindle vacuum port for connection with said vacuum supply means, the apparatus further comprising a central porting member about which said spindles rotate, said central porting member having a vacuum supply port connected to said vacuum supply means, and a vacuum sensing port connected to said monitoring means, said vacuum supply and sensing ports being positioned such that during rotation of one of said spindles past said sheet stack, the spindle vacuum port of said one of said spindles will initially communicate only with said vacuum supply port, then with both said vacuum supply and sensing ports, and finally with only said vacuum sensing port.

4. Apparatus according to claim 1, further comprising a data store, and wherein said monitoring means determines and stores in said data store the monitored amount of pressure when a sheet is deflected.

5. A method of counting sheets using an apparatus comprising a set of rotatably mounted suction spindles mounted for movement past a stack of sheets to be counted, whereby as a suction spindle passes said stack, a vacuum is supplied to said spindle so that a topmost sheet is deflected from its initial position, the method comprising the steps of:

monitoring an amount of vacuum within said suction spindle passing said stack;

incrementing a count on each occasion when said amount of vacuum exceeds a predetermined threshold; and terminating the count process when a predetermined period is exceeded without the amount of vacuum exceeding said predetermined threshold, said predetermined period comprising a time period required for passage of at least two said spindles past the stack of sheets without said spindles deflecting a sheet.

6. A method according to claim 5, wherein said predetermined period is the same throughout a count process.

7. A method according to claim 5, further comprising the step of monitoring an absolute pressure in at least one of said spindles when a sheet is deflected and storing a value representing the monitored pressure.

8. Sheet counting apparatus comprising;

a plurality of rotatably mounted suction spindles mounted for movement past a stack of sheets to be counted;

vacuum supply means connected to said spindles for supplying a vacuum to one of said spindles when said one of said spindles passes said stack so that a topmost sheet is deflected by said one of said spindles from an initial position of the topmost sheet; and monitoring means for monitoring a number of deflected sheets and for monitoring an amount of vacuum within said suction spindle passing the stack, whereby presence of an amount vacuum exceeding a predetermined threshold indicates that a sheet is being deflected, said monitoring means incrementing a count when the amount of vacuum within said suction spindle exceeds the predetermined threshold, and wherein said monitoring means varies said threshold during a count process by resetting the threshold at a preset proportion of a rolling average of a predetermined number of previous vacuum levels detected during the deflection of a sheet.

9. Apparatus according to claim 8, wherein the most recent 8 vacuum levels are averaged.

10. A method of counting sheets using an apparatus comprising a set of rotatably mounted suction spindles mounted for movement past a stack of sheets to be counted, whereby as a suction spindle passes said stack, vacuum is supplied to said spindle so that a topmost sheet is deflected from its initial position, the method comprising the steps of:

monitoring an amount of vacuum within said suction spindle passing said stack, whereby the presence of an amount of vacuum exceeding a predetermined threshold indicates that a sheet has been deflected;

incrementing a count when a vacuum exceeding the predetermined threshold is detected; and varying the threshold during the count process by resetting the threshold at a proportion of a rolling average of a predetermined number of previous vacuum levels detected during deflection of a sheet.

11. A method according to claim 10, wherein the most recent 8 vacuum levels are averaged.

12. A method of feeding a stack of sheets to a sheet processing position, the method comprising the steps of:

mounting the stack against a pivoted support plate; and causing a drive motor to pivot said support plate towards said sheet processing position while sheets from the stack are being processed.

13. Apparatus for feeding a stack of sheets to a sheet processing position, the apparatus comprising:

a pivoted sheet stack support plate against which a stack of sheets is provided; and a motor coupled to said support plate to move said support plate towards said sheet processing position while sheets from the stack are being processed.

14. Apparatus according to claim 13, further comprising a spring, wherein said drive motor is coupled to said support plate via said spring.

15. Apparatus according to claim 14, further comprising a rack and an arm, wherein said spring has first and second ends, and wherein said drive motor is coupled to said rack to which said first end of said spring is connected, said second end of said spring being attached to said arm which is connected to said support plate and pivoted about an axis about which the support plate is pivoted so that rotation of said arm causes rotation of said plate.

16. Apparatus according to claim 15, further comprising a shaft, wherein said arm and said plate are mounted on said shaft.

17. Apparatus according to claim 15, wherein said rack is rotatably mounted about a pivot axis about which said arm and said plate are rotatably mounted.

18. Apparatus according to claim 15, wherein said arm includes a slot and said rack includes a laterally extending pin which is received in said slot in said arm so that said plate is moved to a retracted position by moving said rack and so that said pin contacts an end of said slot and thereafter pivots said arm.

19. Apparatus according to claim 13, further including a clamp arm which is urged into contact with said stack of sheets on said plate.

20. Apparatus according to claim 13, further comprising a plurality of rotatably mounted suction spindles mounted for movement past a stack of sheets to be counted, vacuum supply means connected to said spindles for supplying a vacuum to one of said spindles as said one of said spindles passes said stack so that a topmost sheet of said stack is deflected by said one of said spindles from an initial position of the topmost sheet; and monitoring means for monitoring a number of deflected sheets and for monitoring an amount of vacuum within said suction spindle passing said stack, whereby said monitoring means increments a count on each occasion when a monitored amount of vacuum exceeds a predetermined threshold, said monitoring means terminating the count process when a predetermined period is exceeded without the vacuum exceeding the predetermined threshold, the predetermined period comprising a period of time required for passage of at least two said spindles past said stack of sheets without said spindles deflecting a sheet.

21. Apparatus according to claim 13, further comprising a plurality of rotatably mounted suction spindles mounted for movement past a stack of sheets to be counted, vacuum supply means connected to said spindles for supplying a vacuum to one of said spindles as said one of said spindles passes said stack so that a topmost sheet is deflected by said one of said spindles from an initial position of the topmost sheet; and monitoring means for monitoring a number of deflected sheets and for monitoring an amount of vacuum within said suction spindle passing the stack, whereby presence of a vacuum exceeding a predetermined threshold indicates that a sheet is being deflected, said monitoring means incrementing a count when the vacuum within the suction spindle exceeds the predetermined threshold, and wherein said monitoring means varies said threshold during a count process by resetting the threshold at a preset proportion of a rolling average of a predetermined number of previous vacuum levels detected during deflection of a sheet.

* * * * *